United States Patent [19]

Kellar et al.

[11] Patent Number: 5,003,303

[45] Date of Patent: Mar. 26, 1991

[54] CHARACTER AND OTHER GRAPHICAL GENERATING SYSTEMS FOR VIDEO DISPLAY

[75] Inventors: Paul R. N. Kellar; Anthony D. Searby; David Stone, all of Newbury, England

[73] Assignee: Quantel Limited, Newbury, United Kingdom

[21] Appl. No.: 485,827

[22] Filed: Feb. 27, 1990

Related U.S. Application Data

[63] Continuation of Ser. No. 169,822, Mar. 18, 1988, abandoned.

[30] Foreign Application Priority Data

Mar. 25, 1987 [GB] United Kingdom ..... 8707088

[51] Int. Cl.[5] ..... G09G 5/22

[52] U.S. Cl. ..... 340/723; 340/730; 358/183

[58] Field of Search ..... 340/720, 721, 723, 724, 340/727, 730, 731, 748; 358/183

[56] References Cited

U.S. PATENT DOCUMENTS 4,698,666 10/1987 Lake, Jr. et al. ..... 358/183
4,774,507 9/1988 Kashigi et al. ..... 358/183

FOREIGN PATENT DOCUMENTS 2137857 10/1984 United Kingdom .

*Primary Examiner*—Jeffery A. Brier
*Attorney, Agent, or Firm*—Cooper & Dunham

[57] ABSTRACT

A character generating system is disclosed having a source of batches of video keying signals representing different characters combined with further keying signals representing a background for the respective character. The video keying signals are confined to one value range and said further keying signals are confined to a different value range. The system effects spatial transformation of the combined signals and responds to the values of the spatially transformed combined signals to derive shape signals corresponding to the further keying signals and to derive shade signals corresponding to the video keying signals. In response to the shape and shade signals different video signals are provided respectively representing the character and the background both spatially transformed as the combined signals were spatially transformed.

16 Claims, 2 Drawing Sheets

CHARACTER AND OTHER GRAPHICAL GENERATING SYSTEMS FOR VIDEO DISPLAY

Figure 1:
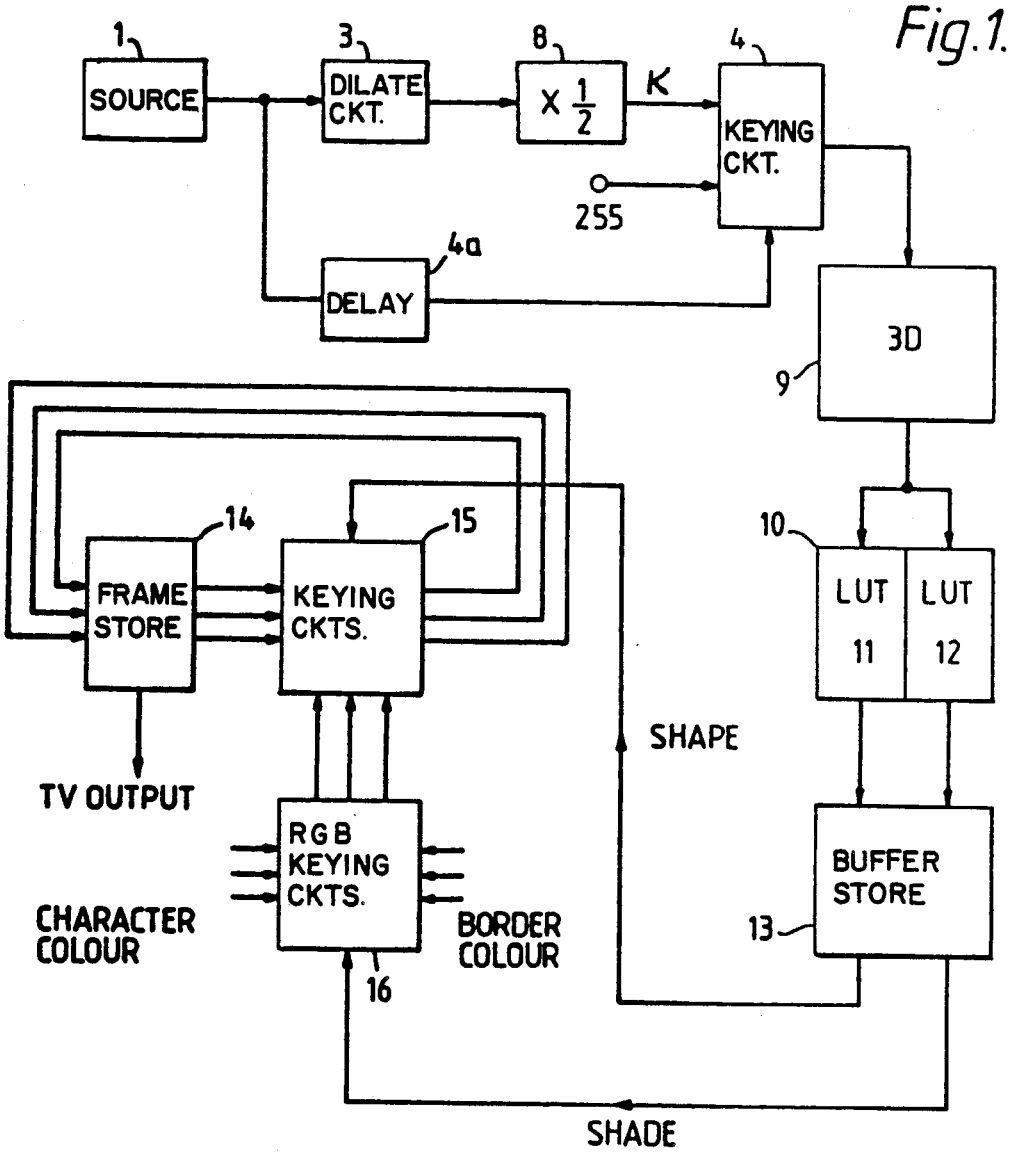

This is a continuation of application Ser. No. 169,822, filed March 18, 1988, now abandoned.

This invention relates to character or graphical generating systems for video display, especially though not exclusively for television.

Character generating systems are already known, which are used for generating captions for TV programs, in which batches of digital video keying signals each representing a character profile in a font of characters are stored, for example in a disc store. When a particular character is required for use in a caption, the respective video keying signals are read from the store, and may then be subjected to 3D manipulation to change the orientation (spin), position or size of the character, or transform it in some other way as required in the caption. The transformed video keying signals may then be written into a framestore along with other manipulated characters for subsequent reading of the caption. A character generator of this kind is described in our co-pending British Patent No. 2137856B (corresponding U.S. patent application Ser. No. 936,990). Features other than characters can also be generated by such systems.

One change which is sometimes required when using such a character generating system is to place a border round or form a shadow of one or more of the characters (or features). With existing character generating systems such a change is difficult to achieve and still maintain anti-aliased quality, and the object of the present invention is to provide an improved character generating system including means to provide the character within a background, such as a border or a shadow, which can be subject to manipulation in the same way as the character without adding undue complexity to the system.

According to the present invention there is provided a character generating system including a source of batches of video keying signals representing different characters combined with further keying signals representing a background for the respective character characterized in that the video keying signals are confined to one value range and said further keying signals are confined to a different value range and the system includes transforming means for effecting spatial transformation of said combined signals, means responsive to the values of said spatially transformed combined signals to derive shape signals corresponding to said further keying signals and to derive shade signals corresponding to said video keying signals, and means responsive to said shape and shade signals to provide different video signals repectively representing said character and said background both as spatially transformed by said transforming means.

As will appear from the following description, the invention has the advantage that if video keying signals included in the original batch have anti-aliasing or soft edging properties, these properties are preserved not only at the edge of the selected character, but also at the edge of the added border or shadow.

Preferably, the means for effecting spatial transformation can effect 3D transformation. The invention has the advantage that only one transforming means is required for transforming both signals simultaneously, the identity of the signals being preserved through the manipulation since one signal is modulated by the other.

In order that the invention may be better understood one example thereof will now be described with reference to the accompanying drawings in which FIG. 1 illustrates diagrammatically and in block form one example of a graphic system having means for enclosing characters within a border.

FIG. 2*a* to FIG. 2*d* are diagrams illustrating the operation of part of the system which dilates and differentiates video signals defining different characters.

Figure 3A:
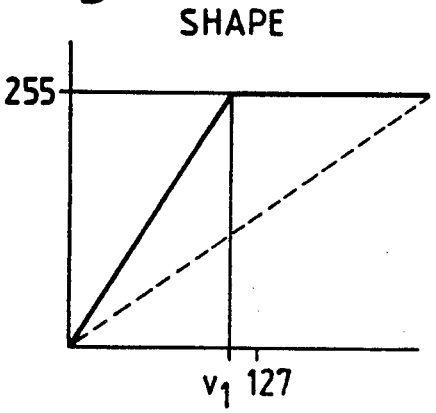
Figure 3B:
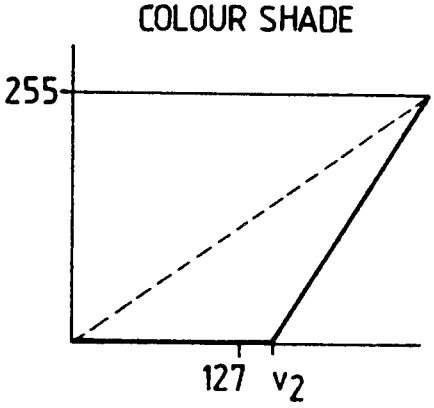

FIG. 3*a* and FIG. 3*b* illustrate the function of look up tables used in the system.

Figure 4A:
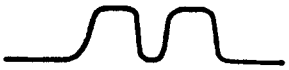
Figure 4B:
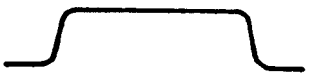

FIG. 4*a* and FIG. 4*b* illustrate the use of shade and shape signals used in the system.

Figure 2A:
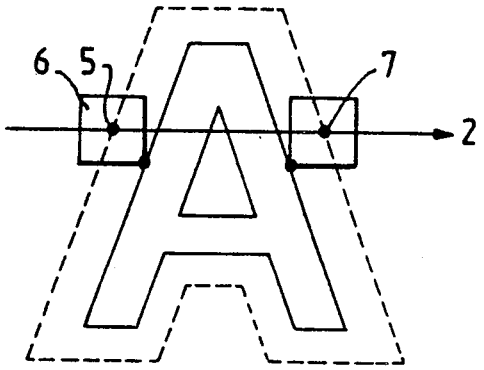
Figure 2B:
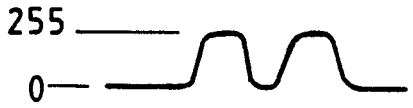

Referring to the drawing, reference 1 denotes a source, such as a store, of digital video keying signals representing different characters. Each character is represented by a batch of video keying signals defining the respective character arranged in a sequence of lines defining a small rectangular frame or tile, as described for example in our published Patent No. 2137856B. The source 1 may be a disc store and one batch of video keying signals is stored for every character available in the store. Normally the store will hold signals defining many different fonts of characters. The video signals may be eight bit signals, so that a signal value in the range from 0 to 255 can be stored for each picture point. FIG. 2*a* shows a representative character A for which it is assumed video keying signals are stored in the store 1, while FIG. 2*b* shows the envelope of the video keying signals for a sequence of picture points along the line 2 in FIG. 2*a*. As indicated the video keying signals may have the values 255 at picture points lying within the boundary of the character except at a few points close to the boundary. For picture points outside the boundary, the video signals have the value 0. As indicated by the inclination of the envelope between value 0 and 255, a few video signals for picture points close to the boundary have values which increase on moving in from the boundary, and lie between 0 and 255. These signals are so called anti-aliasing signals which prevent ragged edges appearing in a picture on which the characters may be introduced. The number of these anti-aliasing signals encountered on moving inward from any boundary is small, in the ranges from 2 to 10 say, and a minimum of two is desirable for the purposes of the present invention as will appear, one having a value below 127 and the other having a value above 128.

Figure 2C:
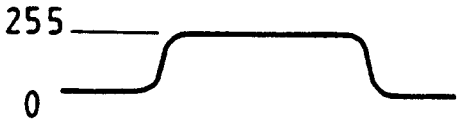

The video keying signals representing any character can be selected from the source 1 by operator choice, using known means. When selection is made, the video keying signals are applied to a dilating circuit 3 and are also applied directly as a key signal K to a keying circuit 4. The video keying signals for picture points occurring along each of the series of lines in the character are applied in succession to the circuits 3 and 4. The dilating circuit is of known form and it serves to transform the video keying signal in the respective batch to represent a projected version of the character. Thus for example the envelope of the signals derived from the dilating circuit, relating to picture points along the line 2, is transformed from FIG. 2*b* to FIG. 2*c* and the effect is of dilating the original character A of FIG. 2*a* to that having the boundaries shown by dotted lines. One method of dilation is achieved by transforming the value of the video keying signal at each picture point in the tile to the highest value of any picture point enclosed within a square matrix of say 15×15 depending on the amount of dilation required. For example considering picture point 5 on FIG. 2*a*, its value is transformed to the highest value for any picture point within the matrix 6. Thus picture point 5 takes the value of a picture point just on the boundary of character A. Similarly for picture point 7 at the other side of the character, on the same line. It can readily be seen that repetition of this transformation for all picture point in the tile will produce a dilation such as represented in FIG. 2*a* and FIG. 2*c*.

The transformed video signals delivered from the dilating circuit 3 are applied to a divide-by-two circuit 8 which reduces the range of values of the transformed signals to 0 to 127. The resultant reduced value signals called "data" are then applied to the keying circuit 4 which as aforesaid receives the untransformed video keying signal from the source or store 1. The keying circuit 4 receives a second input representing the maximum signal value used in the system, namely 255 in this example. Reference 4*a* represents a delay device to compensate for delays in the circuits 3 and 8. The keying circuit 4 is arranged to pass to the output, for each picture point, a signal defined by:

$$\frac{K}{256} \times 255 + \left(1 - \frac{K}{256}\right) \times \text{data}$$

where K is in the range 0–255

Figure 2D:
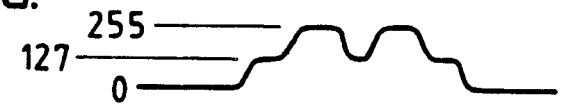

Consideration of this expression will show that for picture points where the original video keying signals have value zero, the output equals the half value data signals and when the original video signals have value 255, the output is practically equal to said original video keying signals. For a picture point where the original video keying signal has an intermediate anti-aliasing value, the output has an anti-aliasing value between 127 and 255. The result of the operation of the keying circuit is to produce video signals for picture points in the line 2, the values of which have an envelope such as shown in FIG. 2*d*. The output of the circuit 4 is a combination of signals comprising signals in one value range derived from the video keying signals and signals in a different value range derived form said data signals. For example in producing 3D transformation, signals for a particular pixel may be drived by interpolating adjacent combination signals. If the interpolation is carried out between anti-aliasing values, the interpolations will be bounded by adjacent pixel values, and signal level separations will be maintained. If interpolation is between values in the different amplitude ranges the edge of the character may shift slightly, as required.

The video signals from the keying circuit 4 are passed to a processing circuit 9, which is capable of producing 3D manipulation of the modulated shape signals, to change the orientation position, size or other parameter of the character represented by the signals. Such processing circuits are of known form, for example as used in the Cypher character generating system manufactured by the present assignee, (Quantel Limited, Newbury, Berkshire, England) or as describe in UK Patent 2137856 B. The use of the processing circuit as illustrated in FIG. 1 has the advantage that only one circuit is required since the border information and the original character information are combined in one signal when applied to the processing circuit. The processing circuit may transform the video keying signals applied to it in such a way that the envelope of signal values for picture points in line 2 might be changed substantially from that shown on FIG. 2*d* by reason of movement to new addresses, but such change make little difference to the operation of the means for adding borders.

The modulated shape signals output from the processing circuit 9 are applied to a circuit 10 including two look up tables LUT 11 and LUT 12. The first of these tables, called the "shape" table has a input/output characteristic such as represented in FIG. 3*a*. Thus, digital input signals having values in the range 0 to $v_1$ (just under 127) are expanded to the range from 0 to 255, and all input signals having a value exceeding $v_1$, are limited at the value 255. Therefore, LUT 11 demodulates the envelope FIG. 2*d* and converts it back to the original dilated envelope of FIG. 2*c* the signal output FIG. 4*b* defining the shape of the character to be displayed. The second table, LUT 12, carries out the converse function; all input signals having values in the range from 0 to $v_2$ just over 127 are reduced to value 0, whilst modulation signals having values in the range $v_2$ to 255 are expanded to the range from 0 to 255. This effect produce signals which correspond closely to the original signals derived from the store 1 and these signals are called "colour shade" (FIG. 4*a*). We thus have signals from LUT 11 and LUT 12 respectively defining the outer border of the dilated character, and the boundary of the original character (subject of course to any transformation of the character in the circuit 9). The shape and shade signals are applied to buffer store 13 where they are stored in readiness for inserting the character into a picture, assumed to be a television picture though it could be a picture for printing or reproduction in other ways.

Reference 14 denotes a frame store, and it will be assumed to store video signals defining a television picture in which it is required to introduce the character defined by the aforesaid shade and shape signals. When the introduction is carried out, the video signals representing the television picture are read from the store 14 in raster format. The video signals are each of three components, say RGB, so that the picture can be reproduced in colour, and the three components signals for successive picture points are applied to three keying circuits 15 (one for each colour component). The keying circuits derive second inputs from three further RGB keying circuits 16. The shape signals are applied as keying signals to the circuits 15 and the colour shade signals are applied as keying signals to the circuits 16.

The two inputs to the circuits 16 are RGB components which represent respectively the character colour and the border colour. The signals are variable at the choice of the operator. For example, the border colour could be chosen to be black or white, whilst the character colour might be say red or orange. The shade and shape signals from the buffer 13 are read in such synchronisation with the frame store 14 that they coincide with video signals from the location in the picture where the character is to be placed.

The keying circuit 16 is set up to produce an output, for any one picture point, represented by $$C = \text{character colour} \times \frac{\text{shade signal}}{256} + \left(1 - \frac{\text{shade signal}}{256}\right) \times$$

border colour; where shade signal is in the range 0–255.

This forms the second input to the keying circuit 15, which produces an output represented by $$P = C \times \frac{\text{shape signal}}{256} + \frac{1 - (\text{shape signal})}{256} \times \text{Frame Store}$$

signals where the shape signal is in the range 0–255.

It can be shown that, when all picture points have been processed, the result is the original framestore picture having superimposed on it the selected character, provided with the required border. The colours of the character and the border can be selected by the operator. Moreover, anti-aliasing is preserved both at the edge of the border and the original character outline.

In an alternative form of the invention, Source 1 is arranged to store the combined signals representing the character complete with background already in place, so that it can be fed directly to the transforming circuit 9. Thus the circuit 3, 4, 4*a* and 8 are not required, and previously derived combination signals are provided by the source 1.

The invention is not confirmed to enclosing characters within a border representing a delated version of the character. It can be applied to forming a shadow for a character or providing some other form of background. In the case of a shadow the further signals can be produced by "delaying" the video keying signals to form the "shadow". The shadow may be displaced in any direction from the character depending on the assumed direction from which the shadow is projected. In order to form the shadow, the circuit operates otherwise as described with reference to FIGS. 1 to 4. The invention can be used for television and also for printing.

We claim:

1. A character generating system for use in keying at least one character into a video picture, the system including:

a source which supplies a first digital video keying signal for keying a character together with an associated second digital keying signal for keying an embellishment for said character, said first and second keying signals being combined to form a combined signal in which the first and second keying signals are confined exclusively to discrete ranges thereof;

transforming means for effecting a spatial transformation to the whole of said combined signal to derive a spatially transformed combined signal;

separating means for separating the first and second keying signals from the spatially transformed combined signal to produce respective spatially transformed first and second keying signals; and means for providing respective video signals representing the character and the embellishment for the character, which means is responsive to said spatially transformed first and second keying signals thereby to provide signals which appear as if spatially transformed by said transforming means.

2. A system as claimed in claim 1, wherein the second keying signal represents a dilated version of the first keying signal.

3. A system as claimed in claim 1, wherein the embellishment represents a shadow of the character.

4. A system as claimed in claim 1, further comprising keying means responsive to said spatially transformed first and second keying signals for keying said respective video signals representing said character and said embellishment for the character into said video picture.

5. A system according to claim 1, further comprising a combining circuit for combining said first and second keying signals to produce said combined signal.

6. A system as claimed in claim 1, wherein said separating means comprises a first look up table responsive to one discrete range of said combined signal to derive said spatially transformed first keying signal, and a second look up table responsive to the other discrete range of said combined signal to derive said spatially transformed second keying signal.

7. A system as claimed in claim 1, wherein the first and second digital video keying signals and the combined signal are each represented by eight bit binary signals, and the system further comprises reducing means for reducing the range of each keying signal to enable said keying signals to be represented by the combined signal.

8. A character generating system for use in keying at least one character into a video picture, the system including:

a source which supplies a first digital keying signal for keying a character;

deriving means for deriving from the first digital keying signal a second digital keying signal for keying an embellishment for said character;

combining means for combining said first and second keying signals to produce a combined signal in which the first and second keying signals are cofnined exclusively to discrete ranges thereof;

transforming means for effecting a spatial transformation to the whole of said combined signal to derive a spatially transformed combined signal;

separating means for separating the first and second keying signals from the spatially transformed combined signal to produce respective spatially transformed first and second keying signals; and means for providing respective video signals representing the character and the embellishment for the character, which means is responsive to said spatially transformed first and second keying signals thereby to provide signals which appear as if spatially transformed by said transforming means.

9. A system as claimed in claim 8, wherein the second keying signal represents a dilated version of the first keying signal.

10. A system as claimed in claim 8, wherein the embellishment represents a shadow of the character.

11. A system as claimed in claim 8, further comprising keying means responsive to said spatially transformed first and second keying signals for keying said respective video signals representing said character and said embellishment for the character into said video picture.

12. A system as claimed in claim 8, wherein said combining means comprises a combining circuit for combining said first and second keying signals.

13. A system as claimed in claim 8, wherein said separating means comprises a first look up table responsive to one discrete range of said combined signal to derive said spatially transformed first keying signal, and a second look up table responsive to the other discrete range of said combined signal to derive said spatially transformed second keying signal.

14. A system as claimed in claim 8, wherein the first and second digital video keying signals and the combined signal are each represented by eight bit binary signals, and the system further comprises reducing means for reducing the range of each keying signal to enable said keying signals to be represented by the combined signal.

15. A method of keying at least one character into a video picture, the method comprising the steps of:

providing a first digital video keying signal for keying a character together with an associated second digital keying signal for keying an embellishment for said character;

combining said first and second keying signals to form a combined signal in which the first and second keying signals are confined exclusively to discrete ranges thereof;

spatially transforming the whole of said combined signal to derive a spatially transformed combined signal;

separating the first and second keying signals from the spatially transformed combined signal to produce respective spatially transformed first and second keying signals; and using the spatially transformed first and second keying signals to key respective video signals representing said character and said embellishment for the character into said video picture.

16. A method as claimed in claim 15, wherein the first and second digital video keying signals and the combined signal are each represented by eight bit binary signals, and the method further comprises the step of reducing the range of each keying signal to enable said keying signals to be represented by the combined signal.

* * * * *